US007758307B2

(12) United States Patent
Van Heusden et al.

(10) Patent No.: US 7,758,307 B2
(45) Date of Patent: Jul. 20, 2010

(54) WEAR MINIMIZATION SYSTEM FOR A COMPRESSOR DIAPHRAGM

(75) Inventors: Gary S. Van Heusden, Oviedo, FL (US); Mehrzad Tartibi, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 670 days.

(21) Appl. No.: 11/804,135

(22) Filed: May 17, 2007

(65) Prior Publication Data

US 2008/0286098 A1 Nov. 20, 2008

(51) Int. Cl.
*F01D 25/28* (2006.01)

(52) U.S. Cl. ..... 415/209.2; 415/213.1; 415/220

(58) Field of Classification Search ..... 415/209.2, 415/213.1, 220
See application file for complete search history.

(56) References Cited

U.S. PATENT DOCUMENTS 1,242,578 A * 10/1917 Moore ..... 415/209.1
1,998,951 A 4/1935 Downer
2,143,467 A 1/1939 Allard
3,026,087 A 3/1962 Welsh
3,169,748 A * 2/1965 Howard et al. ..... 415/209.2
3,619,077 A 11/1971 Wile et al.
3,752,600 A 8/1973 Walsh et al.
3,788,767 A 1/1974 Bednarczyk et al.
3,829,233 A 8/1974 Scalzo et al.
3,861,827 A 1/1975 Peabody et al.
4,032,253 A * 6/1977 Ryncosky et al. ..... 415/136
4,130,375 A 12/1978 Korta
4,393,896 A 7/1983 Slabaugh
4,531,372 A 7/1985 Slabaugh
4,890,978 A 1/1990 McLaurin et al.
5,024,581 A 6/1991 Foucher
5,074,752 A 12/1991 Murphy et al.
5,333,995 A 8/1994 Jacobs et al.
5,380,157 A 1/1995 Shaffer
5,459,995 A 10/1995 Norton et al.
5,487,642 A 1/1996 Norton et al.
5,494,402 A 2/1996 Glezer et al.
5,554,001 A 9/1996 Boyd et al.
5,591,003 A 1/1997 Boyd et al.
5,616,001 A 4/1997 Boyd
5,681,142 A 10/1997 Lewis
5,921,749 A 7/1999 McLaurin et al.
5,988,975 A 11/1999 Pizzi (Continued)

FOREIGN PATENT DOCUMENTS

JP 63263273 A2 10/1988

*Primary Examiner*—Ninh H Nguyen

(57) ABSTRACT

Aspects of the invention relate to a system for reducing relative movement between the outer shroud of a compressor diaphragm and the compressor shell of a turbine engine, thereby minimizing the wear and prolonging the life of such parts. Embodiments of the invention include a system for applying a preload on the outer shroud of a compressor diaphragm. The preload can be applied in the axial and/or radial directions. The preload can be applied at or proximate the joint between two shell segments, which is typically the location of the largest relative movement. In one embodiment, the preload can be achieved by providing one or more load applying members that operatively engage the outer shroud. A load applying member according to aspects of the invention includes a first portion, a second portion, and a biasing member operatively positioned therebetween. The biasing member can be a plurality of spring washers.

20 Claims, 13 Drawing Sheets

U.S. PATENT DOCUMENTS

| | | | |
|---|---|---|---|
| 6,000,906 | A | 12/1999 | Draskovich |
| 6,234,750 | B1 | 5/2001 | Mielke et al. |
| 6,325,596 | B1 | 12/2001 | Tomko |
| 6,352,405 | B1 | 3/2002 | Tomko |
| 6,513,781 | B1 | 2/2003 | Meyer et al. |
| 6,547,523 | B2 | 4/2003 | Nelligan |
| 6,726,448 | B2 | 4/2004 | Farrell et al. |
| 6,733,237 | B2 | 5/2004 | Ingistov |
| 7,008,170 | B2 | 3/2006 | Proveaux et al. |
| 2003/0231957 | A1 | 12/2003 | Anderson et al. |
| 2004/0086384 | A1 | 5/2004 | Mundra et al. |

* cited by examiner

WEAR MINIMIZATION SYSTEM FOR A COMPRESSOR DIAPHRAGM

FIELD OF THE INVENTION

The invention relates in general to turbine engines and, more particularly, to diaphragms used in the compressor section of a turbine engine.

BACKGROUND OF THE INVENTION

The compressor section of a turbine engine can be housed within a compressor outer casing or shell. FIG. 1 generally shows a prior compressor shell 12 that includes an upper half shell 12*a* and a lower half shell 12*b*. The lower shell half 12*b* has two circumferential ends 13. Likewise, the upper shell half 12*a* has two circumferential ends 15. Each circumferential end 13 of the lower shell half 12*b* can be secured to a respective one of the circumferential ends 15 of the upper shell half 12*a*. The abutting ends 13, 15 form a joint 14, which is referred to as the horizontal joint 14 because of its substantially horizontal orientation when assembled.

FIG. 2 shows a compressor section 10 of a turbine engine. In this section, the compressor shell 12 encloses a rotor (not shown) on which multiple rows of airfoils or blades 16 are mounted. The rows of blades 16 alternate with the rows of stationary airfoils or vanes 18, which can be attached to and extend radially inward from the compressor shell 12. In some instances, the vanes 18 can be provided in the form of a diaphragm 20. Each diaphragm 20 can include inner and outer radial bands 22, 24, referred to as shrouds, with a plurality of vanes 18 circumferentially arrayed therebetween. The diaphragm 20 can be made of two semi-circular halves.

The compressor shell 12 can include a slot 26 extending circumferentially along its inner peripheral surface 28. The outer shroud 24, which can be configured with hooks 29, is received in the slot 26 so as to mount the diaphragm 20 on the shell 12. To facilitate installation, ample clearance can be provided between the outer shroud 24 and the slot 26, as generally shown in FIG. 3. However, such clearance allows more relative movement between the diaphragm 20 and the shell 12, which can occur when subjected to vibration and other forces, such as unsteady and steady aero/fluid loads, during compressor operation. Over time, this relative movement between the outer shroud 24 (particularly hooks 29) and the compressor shell 12 can lead to wearing of the interfacing surfaces of these parts. One area of particular concern is at or near the horizontal joint 14 because the largest relative motion occurs at the free ends of the diaphragm 20. Experience has shown that cracks can develop in the outer shroud 24 at or near the horizontal joint 14. Further, wearing of the hooks 29 and/or the compressor shell 12 can allow even greater movement of the diaphragm 20, which, in turn, can cause the inner shroud 22 and/or components attached thereto to rub against neighboring rotating components. Such rubbing can result in significant damage.

Thus, there is a need for a system that can minimize the play between the compressor diaphragm and the compressor shell and the resultant wear.

SUMMARY OF THE INVENTION

Aspects of the invention are directed to a system for reducing wear on a compressor diaphragm. In one aspect, the system includes a generally semi-cylindrical compressor shell segment. The shell segment has an inner peripheral surface, two circumferential ends, an axial upstream end and an axial downstream end. The shell segment includes a slot that extends along the inner peripheral surface from one circumferential end to the other circumferential end.

The system further includes a diaphragm that has an outer shroud with a plurality of airfoils extending radially inward therefrom. The outer shroud is received within the slot in the compressor shell segment. In this way, the diaphragm can be mounted on the compressor shell segment.

According to aspects of the invention, a load applying member is operatively positioned between the compressor shell segment and the diaphragm such that the load applying member exerts a force on the outer shroud. As a result, relative movement between the outer shroud and the compressor shell segment can be minimized. The load applying member can be positioned to exert a force on the outer shroud in any desired direction. In one embodiment, the load applying member can exert a radially inward force on the outer shroud. Alternatively or in addition, the load applying member can exert an axial downstream force and/or an axial upstream force on the outer shroud.

The load applying member has a first portion and a second portion. Either the first portion or the second portion contacts the outer shroud. The first and second portions are biased away from each other by a plurality of springs operatively positioned between them. The springs can be spring washers. In one embodiment, a first spring washer of the plurality of spring washers can be arranged in a first direction, and a second spring washer of the plurality of spring washers can be arranged in a second direction that is opposite the first direction.

In another aspect, a system for reducing wear on a compressor diaphragm includes a generally semi-cylindrical compressor shell segment. The shell segment has an associated inner peripheral surface, two circumferential ends, an axial upstream end and an axial downstream end. The shell segment includes a slot that extends along the inner peripheral surface from one circumferential end to the other circumferential end.

A passage extends in the shell segment. The passage opens into the slot in a region substantially proximate one of the circumferential ends. The passage has a back wall. In one embodiment, the back wall can be formed by the compressor shell segment itself. Alternatively, the back wall can be defined by a first fastener operatively positioned in the passage. In such case, a second fastener can be operatively positioned in the passage. The second fastener can be substantially adjacent to the first fastener. The second fastener can prevent the first fastener from backing out in the passage during engine operation.

The system also includes a diaphragm that has an outer shroud with a plurality of airfoils extending radially inward therefrom. The outer shroud is received within the slot in the compressor shell segment. Thus, the diaphragm can be mounted on the compressor shell segment. The outer shroud can have an associated forward face and aft face.

According to aspects of the invention, the system includes a load applying member that is at least partially received in the passage in the compressor shell segment such that the load applying member exerts a force on the outer shroud. The load applying member can exert a substantially uniform load on the outer shroud. As a result, relative movement between the outer shroud and the compressor shell segment is minimized. The load applying member has a first contact surface at one end and a second contact surface at an opposite end.

The load applying member includes a first portion and a second portion. The first contact surface is defined by the first portion, and the second contact surface is defined by the second portion. The second portion has a base and a protrusion extending from the base. The protrusion can have an associated axis. In one embodiment, the second contact surface can be angled from about 30 degrees to about 60 degrees relative to the axis.

The first portion has an internal passage. At least a portion of the protrusion is received in the passage in the first portion. In one embodiment, the first and second portions can be connected by a retaining member.

Either the first portion or the second portion contacts the outer shroud. Thus, either the first contact surface or the second contact surface engages the back wall of the passage. The other of the first contact surface and the second contact surface engages the outer shroud. The first contact surface and/or the second contact surface of the load applying member can be coated with a wear resistant material.

The loading applying member further includes a plurality of springs operatively positioned between the first and second portions such that the first and second portions are biased away from each other. The springs can be spring washers. In one embodiment, a first one of the spring washers can be arranged in a first direction, and a second one of the spring washers can be arranged in a second direction that is opposite the first direction. In one embodiment, there can be a first group of spring washers and a second group of spring washers. The quantity of spring washers in the first group may or may not be equal to the quantity of spring washers in the second group.

The passage in the shell segment can extend substantially radially in the compressor shell segment. In such case, the load applying member can exert a radially inward force on the outer shroud. In one embodiment, the passage in the shell segment can open into the slot toward the axial upstream end of the shell segment. Thus, the load applying member can exert an axial force on the aft face of the outer shroud in the axial upstream direction. Alternatively, the passage in the shell segment can open into the slot toward the axial downstream end of the shell segment. Thus, the load applying member can exert a force on the forward face of the outer shroud in the axial downstream direction.

DETAILED DESCRIPTION OF EMBODIMENTS OF THE INVENTION

Aspects of the invention are directed to systems for reducing the amount of relative movement between a compressor diaphragm and a compressor shell, thereby minimizing wear and increasing the potential lifespan of such components. Embodiments of the invention will be explained in the context of one possible system, but the detailed description is intended only as exemplary. Embodiments of the invention are shown in FIGS. 4-15, but the present invention is not limited to the illustrated structure or application.

Figure 1:
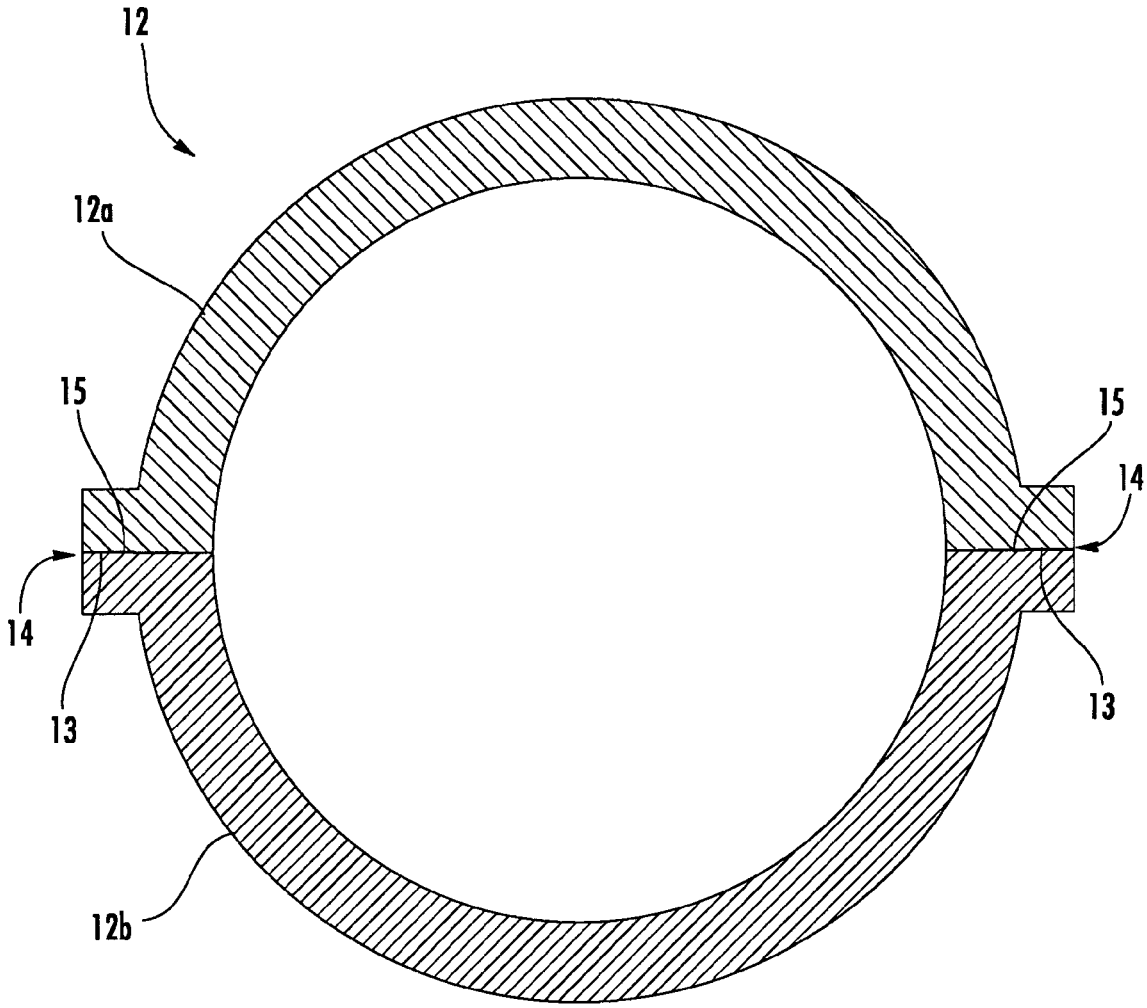
FIG. 1 (PRIOR ART)
FIG. 1 is a front elevation cross-sectional view of a prior compressor shell, showing a horizontal joint formed between an upper shell half and a lower shell half.
Figure 2:
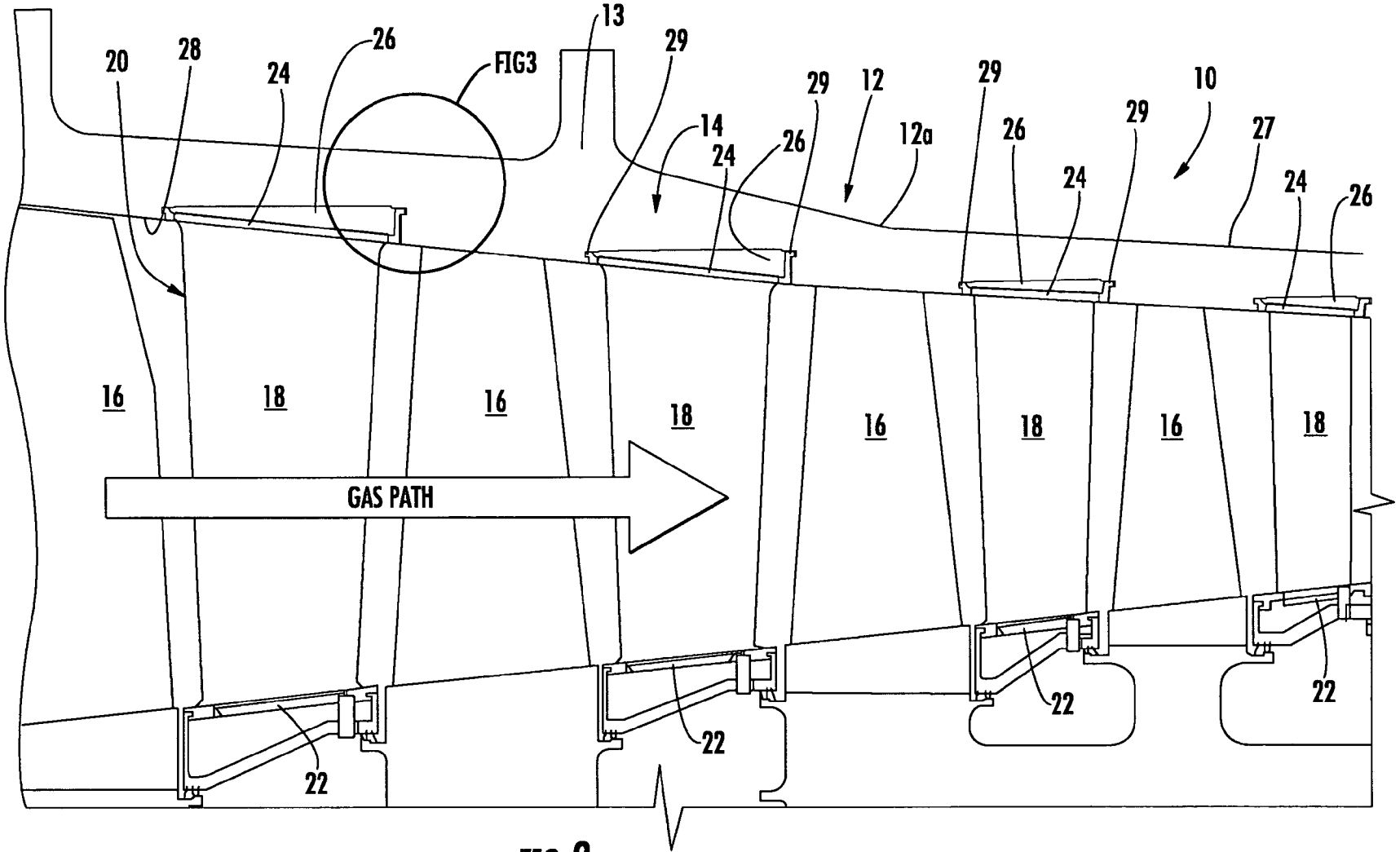
FIG. 2 (PRIOR ART)
FIG. 2 is a top plan view of a portion of a prior compressor section of a turbine engine, with the upper compressor shell is removed for clarity.
Figure 3:
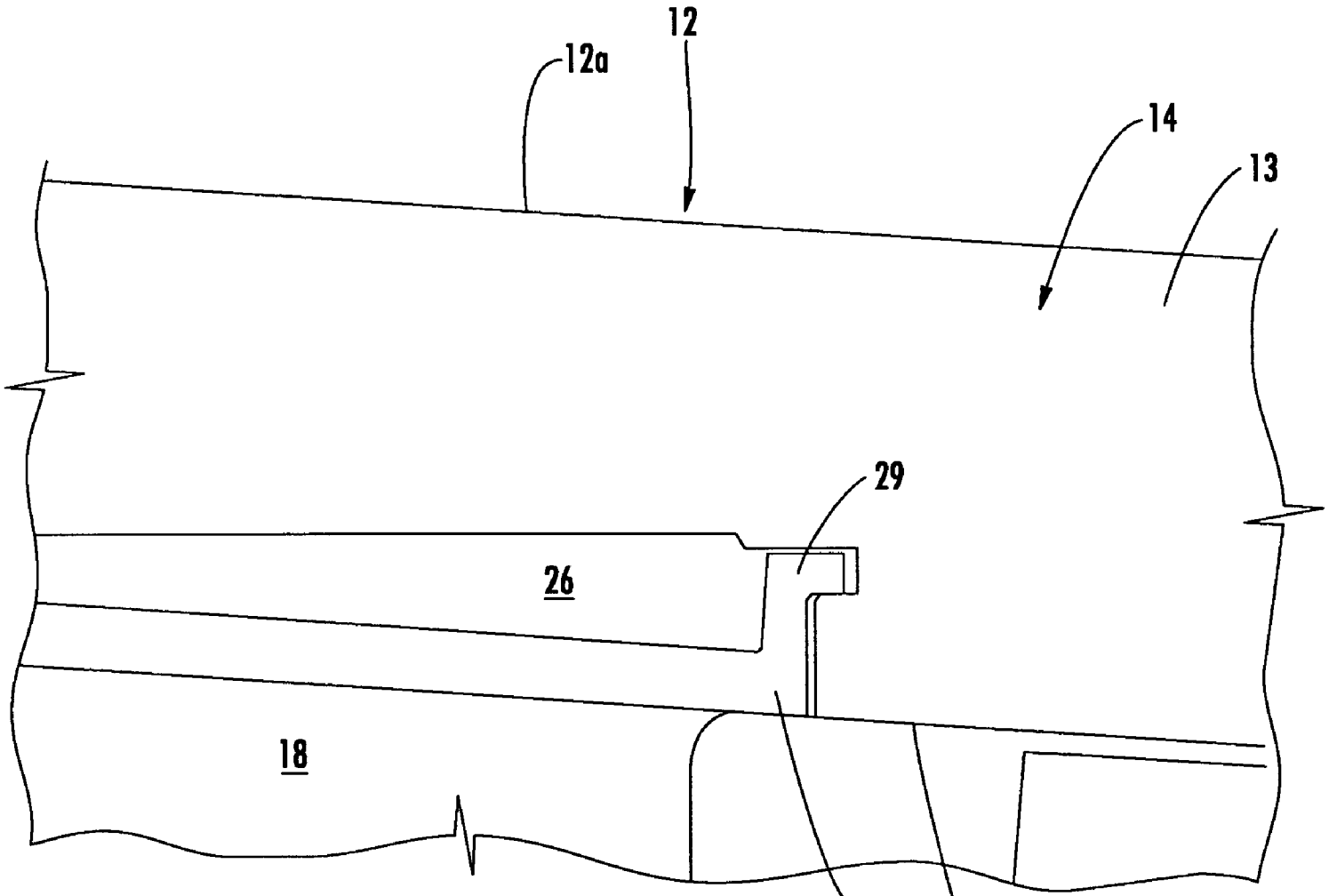
FIG. 3 (PRIOR ART)
FIG. 3 is a close-up view of the prior compressor, taken at view FIG. 3 in FIG. 1, showing the interface between a compressor diaphragm hook and a slot in the compressor shell.
Figure 4:
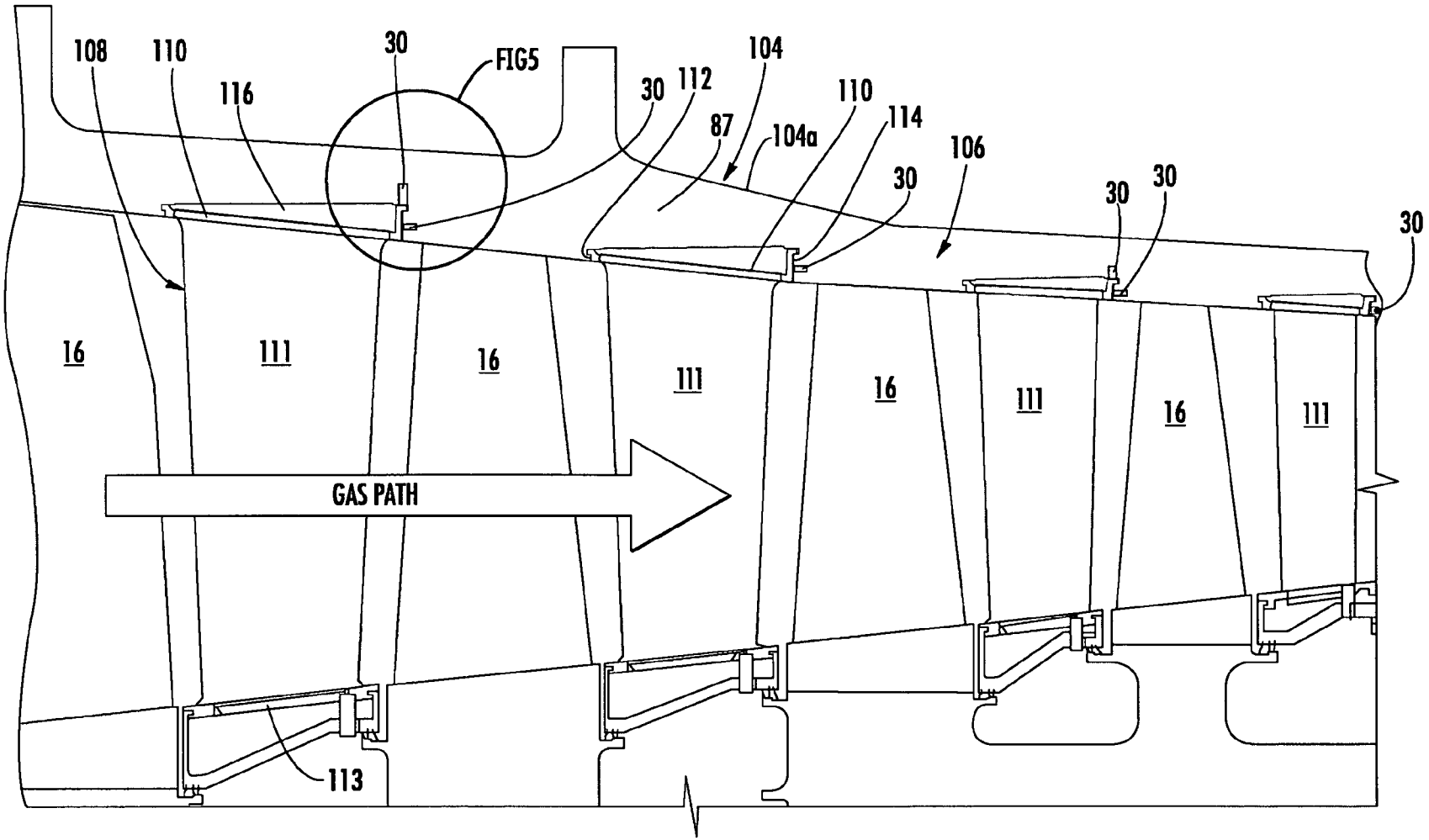
FIG. 4 is a top plan view of a portion of a compressor for a turbine engine with an upper compressor shell segment removed, generally showing load applying members in accordance with aspects of the invention.
Figure 5:
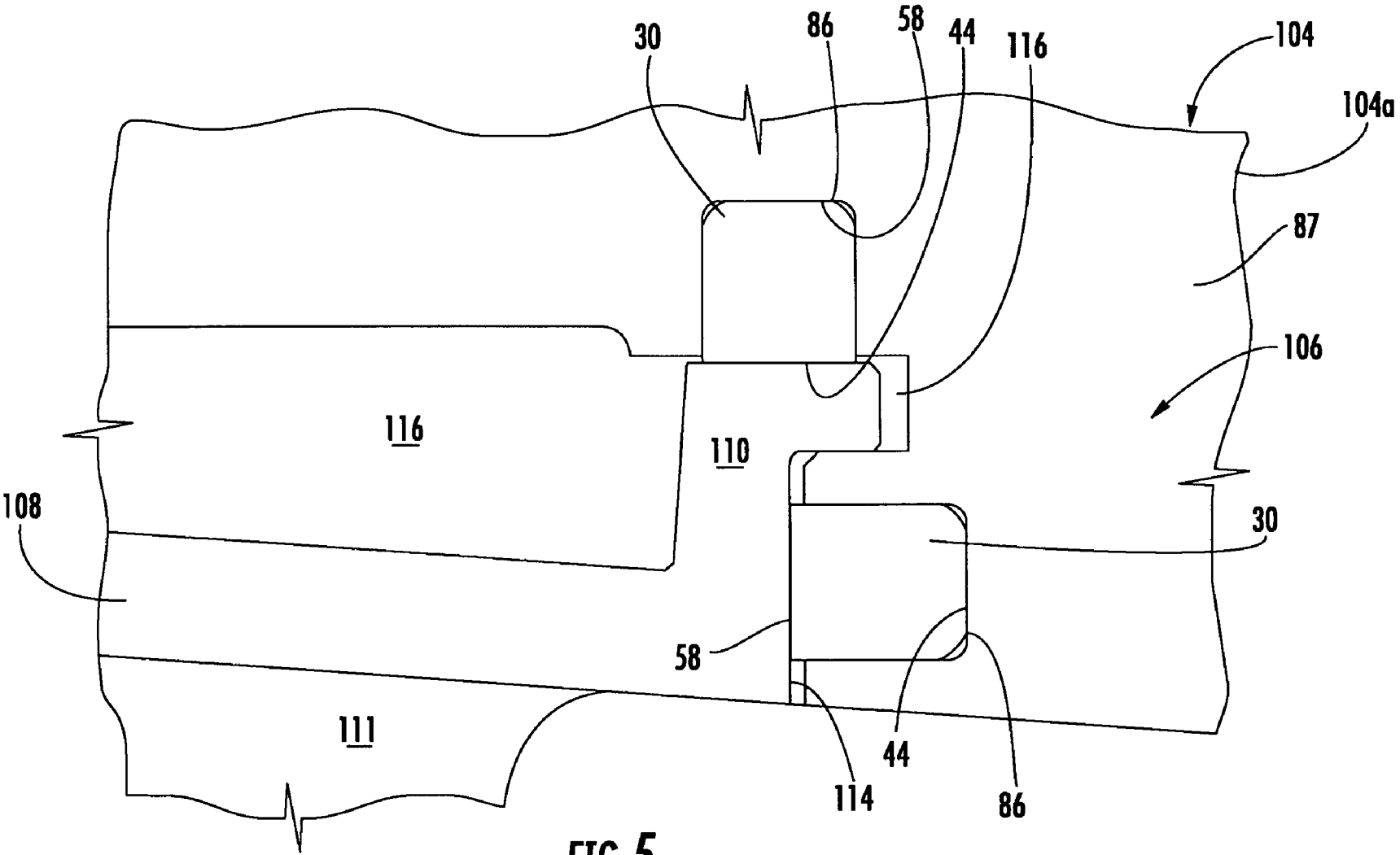
FIG. 5 is a close-up view of a compressor according to aspects of the invention, showing the engagement between load applying members and the compressor diaphragm, taken at view FIG. 5 in FIG. 4.
Figure 6:
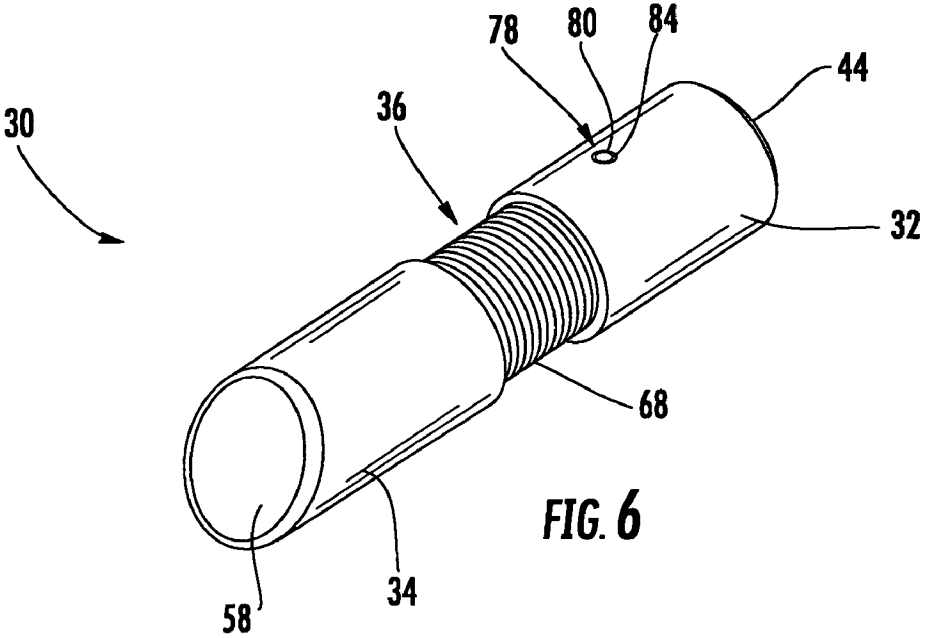
FIG. 6 is an isometric view of a first embodiment of a load applying member according to aspects of the invention.
Figure 12:
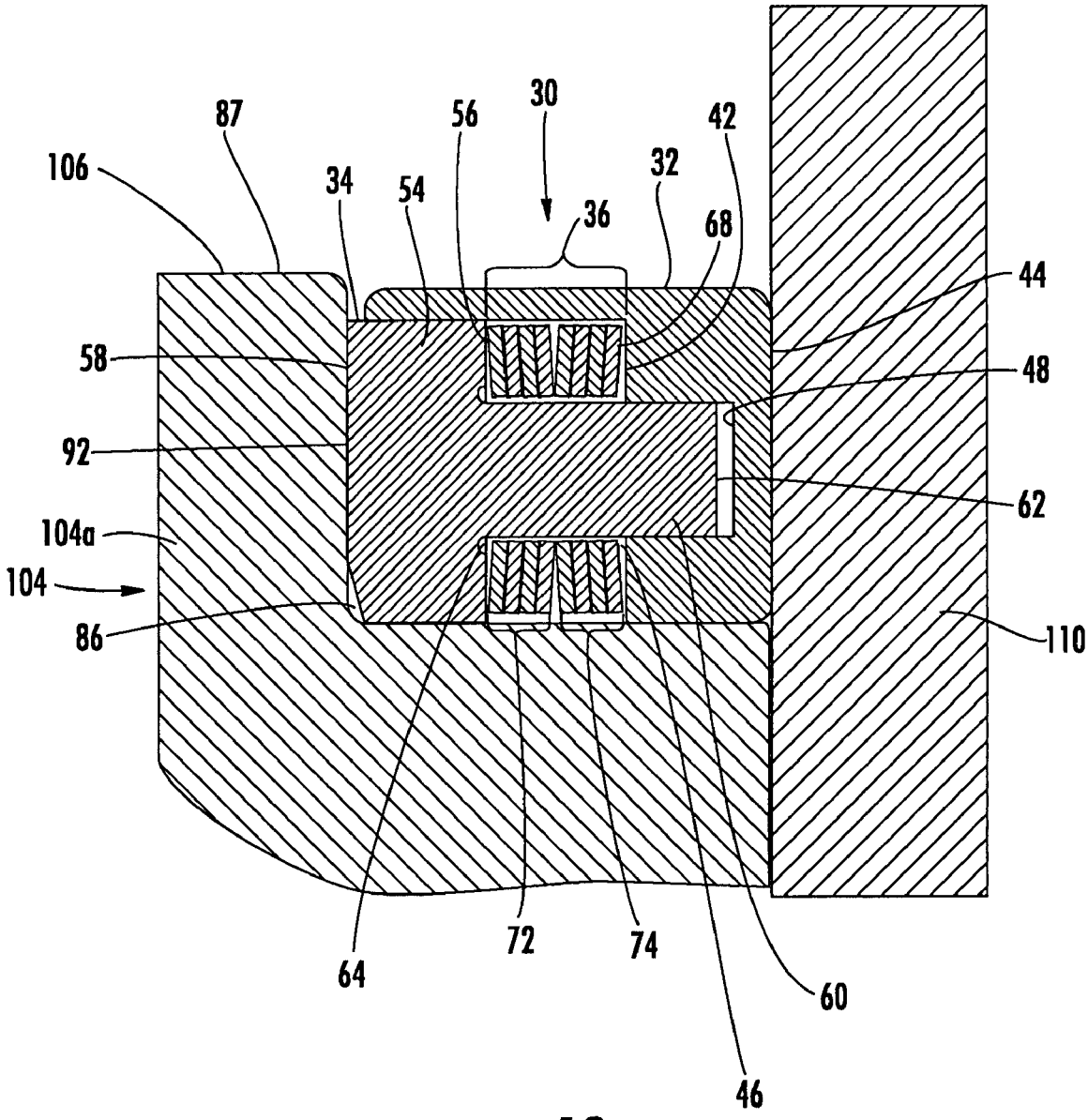
FIG. 12 is a side elevational cross-section view of a second embodiment of a load applying member in accordance with aspects of the invention, showing the load applying member in its operational position.

Diaphragm wear can be minimized according to aspects of the invention by applying a preload on the diaphragm, preferably at or near the joint. The preload can be exerted by way of a load applying member 30, as is generally shown in FIGS. 4 and 5. A load applying member according to aspects of the invention can have any of a number of configurations. One example of a load applying member 30 according to aspects of the invention is shown in FIG. 6. Another example of a load applying member according to aspects of the invention is shown in FIG. 12. While the description below will be directed to the configuration in FIG. 6, it will be understood that this description can have equal application to the configuration in FIG. 12.

Figure 7:
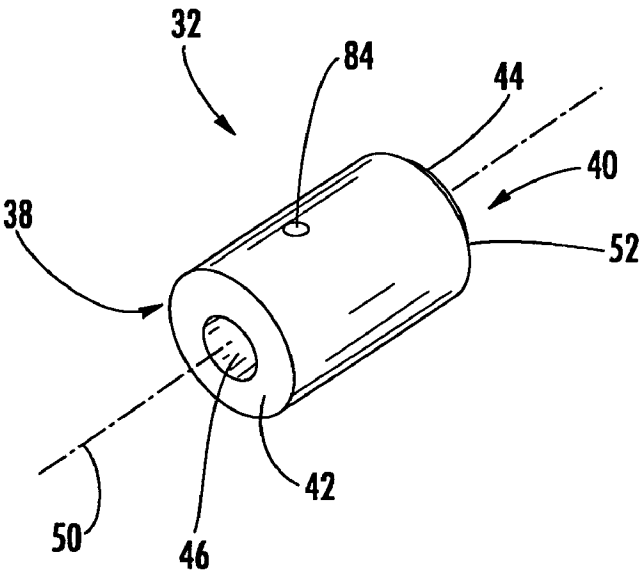
FIG. 7 is an isometric view of a first portion of the load applying member of FIG. 6.

The load applying member 30 includes a first portion 32 and a separate second portion 34, and a biasing member 36 operatively positioned therebetween such that the first and second portions 32, 34 are biased away from each other. The first portion 32 can have any suitable conformation. For instance, the first portion 32 can be generally cylindrical or generally rectangular, as is shown in FIG. 7. The first portion 32 can have a first end 38 and a second end 40 that is opposite the first end 38. The first portion 32 can include a first bearing surface 42 and a first contact surface 44.

The first portion 32 can include a passage 46 therein. The passage 46 can extend from the first end 38 toward the second end 40. In one embodiment, the passage 46 can terminate before reaching the second end 40, thereby forming an end wall 48 (as is shown in FIG. 12). As will be explained in more detail below, the passage 46 can be sized and shaped relative to at least a part of the second portion 34. The passage 46 can be substantially straight, but it can also include one or more bends, curves or other non-straight features. The passage 46 can have a substantially uniform cross-sectional area and shape, or it can vary along at least a portion of its length. The passage 46 can have an associated axis 50. The passage 46 can be centrally located in the first portion 32. However, in some instances, the passage 46 can be off-center.

The second end 40 of the first portion 32 can define the first contact surface 44. The first contact surface 44 can be substantially smooth. The first contact surface 44 can extend at any suitable angle relative to the axis 50. In one embodiment, the first contact surface 44 can extend at substantially 90 degrees relative to the axis 50. In one embodiment, the first contact surface 44 can be angled from about 30 degrees to about 60 degrees relative to the axis 50. A friction reducing material 52, such as Teflon or other suitable material, can be applied to at least a portion of the first contact surface 44. Use of such a material 52 can reduce the friction between and, consequently, the wearing of the first contact surface 44 and the outer shroud.

Figure 8:
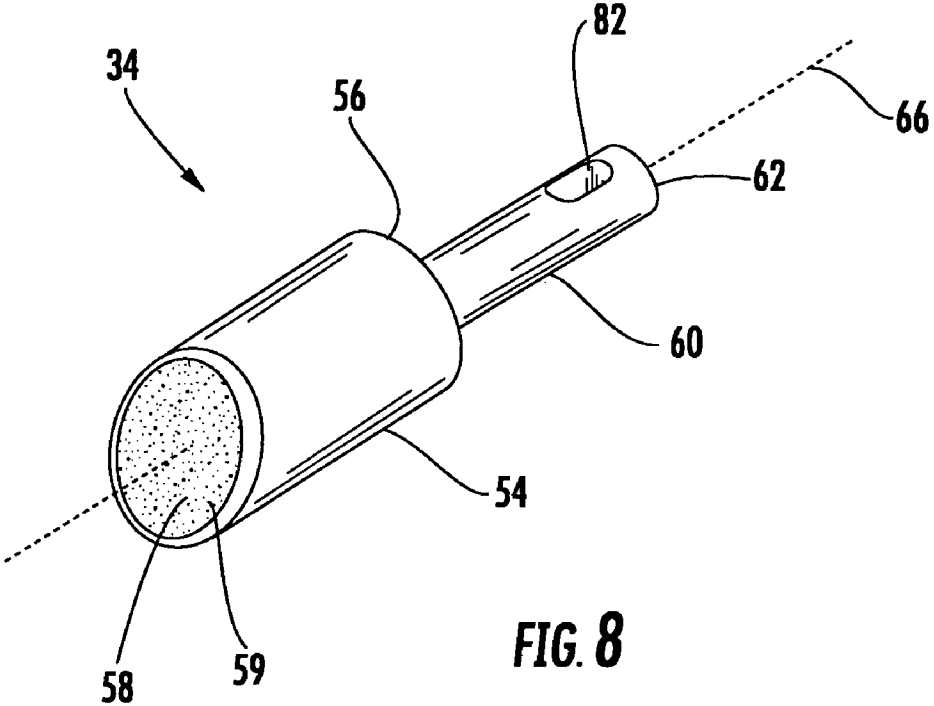
FIG. 8 is an isometric view of a second portion of the load applying member of FIG. 6.
Figure 9:
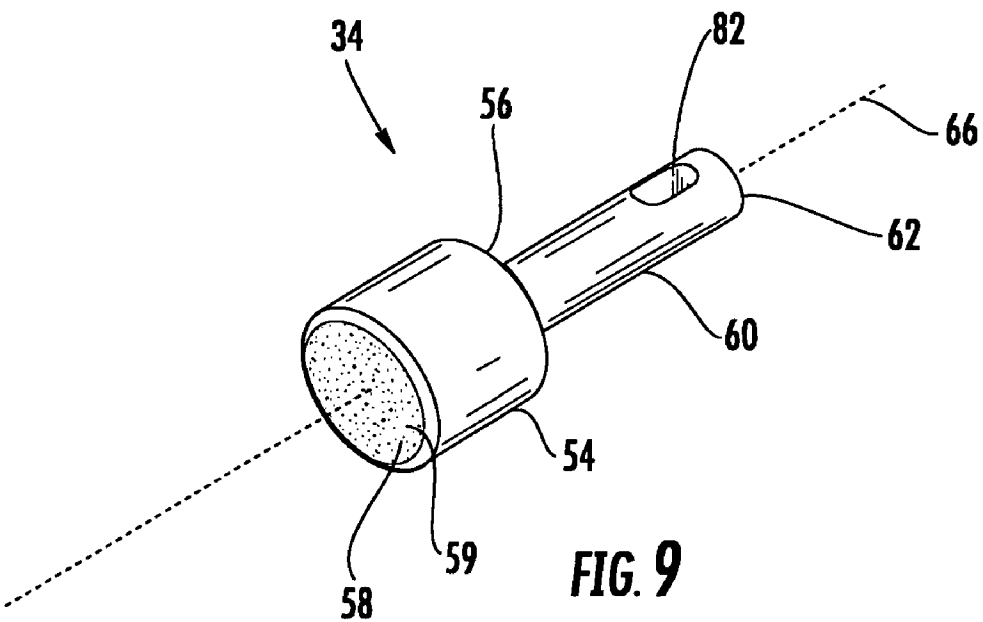
FIG. 9 is an isometric view of an alternative second portion of the load applying member of FIG. 6.

Referring to FIGS. 8 and 9, the second portion 34 can include a base 54. The base 54 can have any suitable conformation. For example, the base 54 can be generally cylindrical. In one embodiment, the base 54 can be generally rectangular (see FIG. 12). The base 54 can define a second bearing surface 56 and a second contact surface 58. The second contact surface 58 can be substantially smooth. The second contact surface 58 can extend at any suitable angle relative to the axis 50. In one embodiment, the second contact surface 58 can extend at substantially 90 degrees relative to the axis 50 (see FIG. 9). In one embodiment, the second contact surface 58 can be angled from about 30 degrees to about 60 degrees relative to the axis 50 (see FIG. 8). At least a portion of the second contact surface 58 can be coated with a friction reducing material 59, including, for example, Teflon.

An elongated protrusion 60 can extend away from the base 54. More particularly, the protrusion 60 can extend away from the second bearing surface 56 of the base 54. The protrusion 60 can extend away from the base 54 at any suitable angle toward a distal end 62. In one embodiment, the protrusion 60 can extend away from the base 54 at substantially 90 degrees. The distal end 62 of the protrusion 60 can be chamfered.

The protrusion 60 can be centrally located on the base 54, but, in some embodiments, the protrusion 60 can be off-center. The protrusion 60 can have any suitable shape. In one embodiment, the protrusion 60 can be substantially cylindrical, but other conformations, including rectangular, circular, semi-circular, ovular, polygonal or triangular, are possible. In one embodiment, the protrusion 60 can account for a majority of the overall length of the second portion 34. The cross-sectional area of the protrusion 60 can be substantially uniform along its length; however, there can be localized regions with a greater or reduced cross-sectional area. The protrusion 60 can have an associated axis 66.

Figure 10:
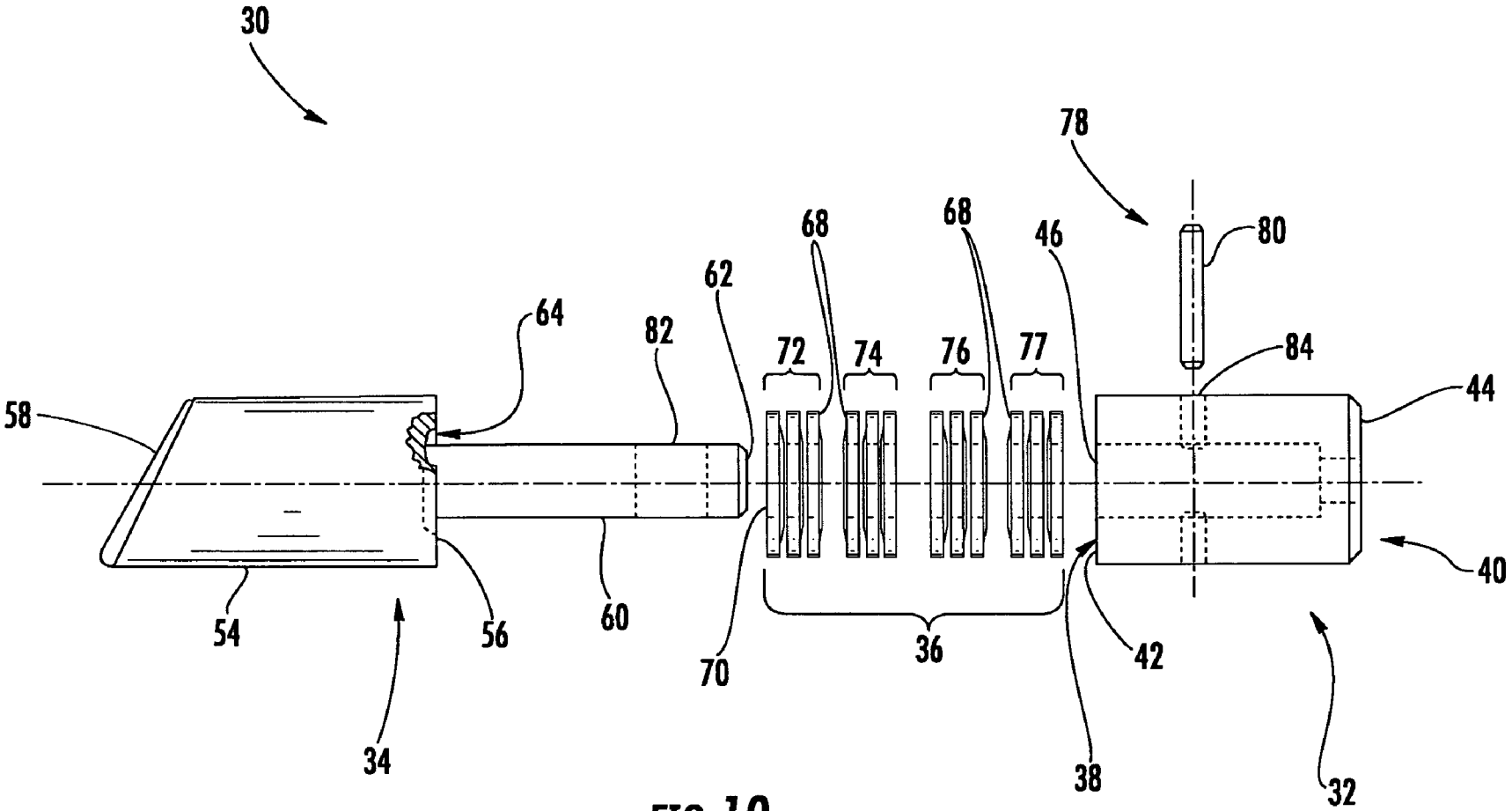
FIG. 10 is a side elevational exploded view of the load applying member of FIG. 6.

As noted above, the first and second portions 32, 34 can be biased away from each other by a biasing member 36. The biasing member 36 can be operatively positioned between the first and second portions 32, 34 so that the biasing member 36 operatively engages the first and second bearing surfaces 42, 56. The biasing member 36 can be any suitable device. In one embodiment, the biasing member 36 can be one or more springs. More particularly, as shown in FIG. 10, the springs can be spring washers 68, such as Belleville washers or conical washers. In embodiments in which the second portion 34 includes a protrusion 60, the spring washers 68 can be positioned so that the protrusion 60 extends through the central hole 70 in each of the spring washers 68. It should be noted that the first portion 32 and/or the second portion 34 can be configured as needed to accommodate the spring washers 68. For example, in one embodiment, there can be an undercut 64 in the base 54 at least in the area surrounding the protrusion 60.

There can be any suitable quantity of spring washers 68, and the spring washers 68 can be arranged in any suitable manner to achieve the desired biasing force. In one embodiment, all of the spring washers 68 can be arranged in the same direction—a first direction. Alternatively, at least one spring washer 68 can be arranged in a second direction that is opposite the first direction of the other spring washers 68. One example of such an arrangement is shown in FIG. 12 in which a first group 72 of spring washers 68 is arranged a first direction, and a second group 74 of spring washers 68 is arranged in a second direction that is opposite to the first direction. The first group 72 of spring washers 68 can be adjacent to the second group 74 of spring washers 68. It should be noted that the quantity of spring washers 68 in the first group 72 and the second group 74 can be equal. However, in some embodiments, the quantity of spring washers 68 in the first group 72 and the second group 74 can be unequal.

Variations of such an arrangement are readily apparent. For example, in addition to the first and second groups 72, 74 of spring washers 68, there can be a third group 76 of spring washers 68, as shown in FIG. 10. In such case, the second group 74 of spring washers 68 can be operatively positioned between the first and third groups 72, 76 of spring washers 68. At one of its ends, the second group 74 of spring washers 68 can directly contact the first group 72; at its other end, the second group 74 of spring washers 68 can directly contact the third group 76. Each of the spring washers 68 in the first group 72 and the third group 76 of spring washers 68 can be arranged in a first direction. Each of the spring washers 68 in the second group 74 can be arranged in a second direction that is opposite the first direction.

Further, a fourth group 77 of spring washers 68 can be provided. The fourth group 77 of spring washers 68 can be positioned adjacent to the third group of spring washers, as shown in FIG. 10. Thus, the third group 76 of spring washers 68 can be operatively positioned between the second and fourth groups 74, 77. When assembled, one end of the first group 72 of spring washers 68 can operatively engage one of the first bearing surface 42 and the second bearing surface 56 of the load applying member 30. One end of the fourth group 77 of spring washers 68 can operatively engage the opposite bearing surface 42 or 56 of the load applying member 30. While the spring washers 68 in FIG. 10 are shown as being arranged in four groups, it will be understood that any number of groups can be provided. There may be more than four groups of spring washers or fewer than four groups. Further, it will be understood that the term "group" as used herein in connection with the spring washers 68 is not limited to the presence of at least two spring washers 68. One or more of these groups can comprise a single spring washer 68. Again, aspects of the invention are not limited to any particular arrangement of spring washers 68. The arrangement can be determined for each application at hand.

The first and second portions 32, 34 can have any suitable spatial relationship. For example, at least a portion of the second portion 34 can be received in the first portion 32, as is shown in FIG. 12. For example, the protrusion 60 of the second portion 34 can be received in the passage 46 in the first portion 32. The passage 46 can be sized to receive the protrusion 60. In one embodiment, the passage 46 can substantially matingly receive the protrusion 60. When assembled, the distal end 62 of the protrusion 60 can be spaced from the end wall 48 of the passage 46. In some instances, at least a portion of the base 52 can be received in the first portion 32, as shown in FIG. 12.

The first and second portions 32, 34 can be completely separate from each other; that is, the first and second portions 32, 34 can be unconnected. Alternatively, the first and second portions 32, 34 can be connected together. A connection between the first and second portions 32, 34 may be desirable to minimize the possibility of separation of the first and second portions 32, 34 during engine operation. In the event of separation, it is possible that one or more components of the load applying member 30 can enter the flow path, which can cause significant damage.

The first and second portions 32, 34 can be connected in any of a number of ways, such as by use of a retaining member 78. Referring to FIGS. 6 and 10, the retaining member 78 can be any suitable device, including, for example, one or more spring pins 80. The first and second portions 32, 34 can be adapted accordingly to facilitate their connection. For example, a passage 82 can be provided in the protrusion 60 (see FIGS. 8 and 9). The passage 82 can be elongated to allow for some play between the first and second portions 32, 34. The passage 82 can extend at an angle, such as about 90 degrees, relative to the axis 66 of the protrusion 60. The passage 82 can be located near the distal end 62 of the protrusion 60. The passage 82 can extend at least partially through the protrusion 60. At least a portion of the retaining member 78 can extend into the passage 82 and into engagement with at least a portion of the first portion 32. For example, the retaining member 78 can extend into engagement with a passage 84 in the first portion 32.

Referring to FIG. 5, the load applying member 30 can be operatively positioned between a compressor shell 104 and an outer shroud 110 of a compressor diaphragm 108 so that one of the first and second contact surfaces 44, 58 of the load applying member 30 operatively engages the outer shroud 110. The diaphragm 108 can have a plurality of airfoils 111 extending substantially radially inward from the outer shroud 110. The diaphragm can also include an inner shroud 113. The compressor shell 104 can be adapted as needed to accommodate the load applying member 30. For example, a passage 86 can be provided in the compressor shell 104. The passage 86 can be made by any conventional machining process and can be included on newly manufactured compressor shells as well as existing compressor shells by field modification.

Figure 13:
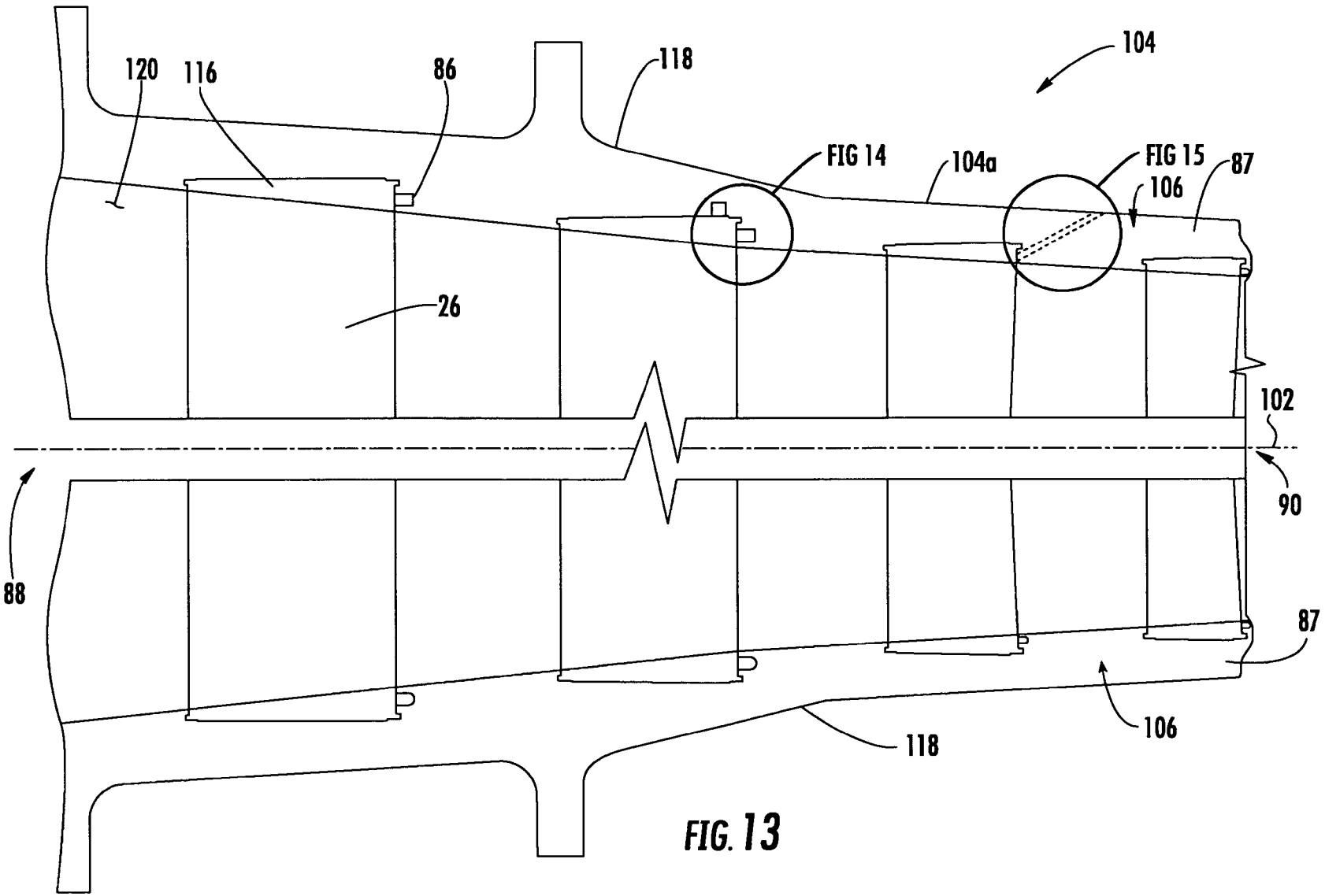
FIG. 13 is a top plan view of a compressor shell segment according to an embodiment of the invention, with additional hardware removed for clarity.

To facilitate discussion of the passage 86, additional features of the compressor shell 104 will be mentioned at this time, referring to FIG. 13. The compressor shell 104 can be generally cylindrical. The compressor shell 104 can be made of two or more substantially semi-cylindrical shell segments (only one shell segment 104*a* is shown in FIG. 13). The term semi-cylindrical may connote a true half-cylinder formed by cutting a cylinder along a single plane parallel to and passing through the longitudinal axis of the cylinder. However, it will be understood that the use of the term "semi-cylindrical" herein is not so limited. The term "semi-cylindrical" can include any portion of a cylinder that is cut by one or more planes extending in a direction that is substantially parallel to the longitudinal axis of the cylinder. These planes may or may not pass through the longitudinal axis of the cylinder. For example, the term "semi-cylindrical" can include shell segments 104*a* that are from about one eighth to about seven eighths of a cylinder. The term "semi-cylindrical" can include shell segments 104*a* that are about one quarter, one third, one half, two-thirds or three-quarters of a cylinder, just to name a few possibilities. The plurality of shell segments 104*a* may or may not be substantially identical to each other.

The plurality of shell segments 104*a* can collectively define the compressor shell. The compressor shell 104 and each semi-cylindrical shell segment 104*a* can have a radially outer peripheral surface 118 and a radially inner peripheral surface 120. Further, each shell segment 104*a* can have two circumferential ends 87. Each circumferential end 87 can substantially abut a respective circumferential end of another shell segment (not shown) to form a joint 106. In one embodiment, the joint 106 can be a substantially horizontally oriented joint. The compressor shell 104 and each shell segment 104*a* can have an axial upstream end 88 and an axial downstream end 90—the terms "axial," "upstream" and "downstream" referring to the general direction of fluid flow through the compressor section. Each shell segment 104*a* can include a slot 116 extending along the radially inner peripheral surface 120 from one circumferential end 87 to the other circumferential end 87.

Figure 11:
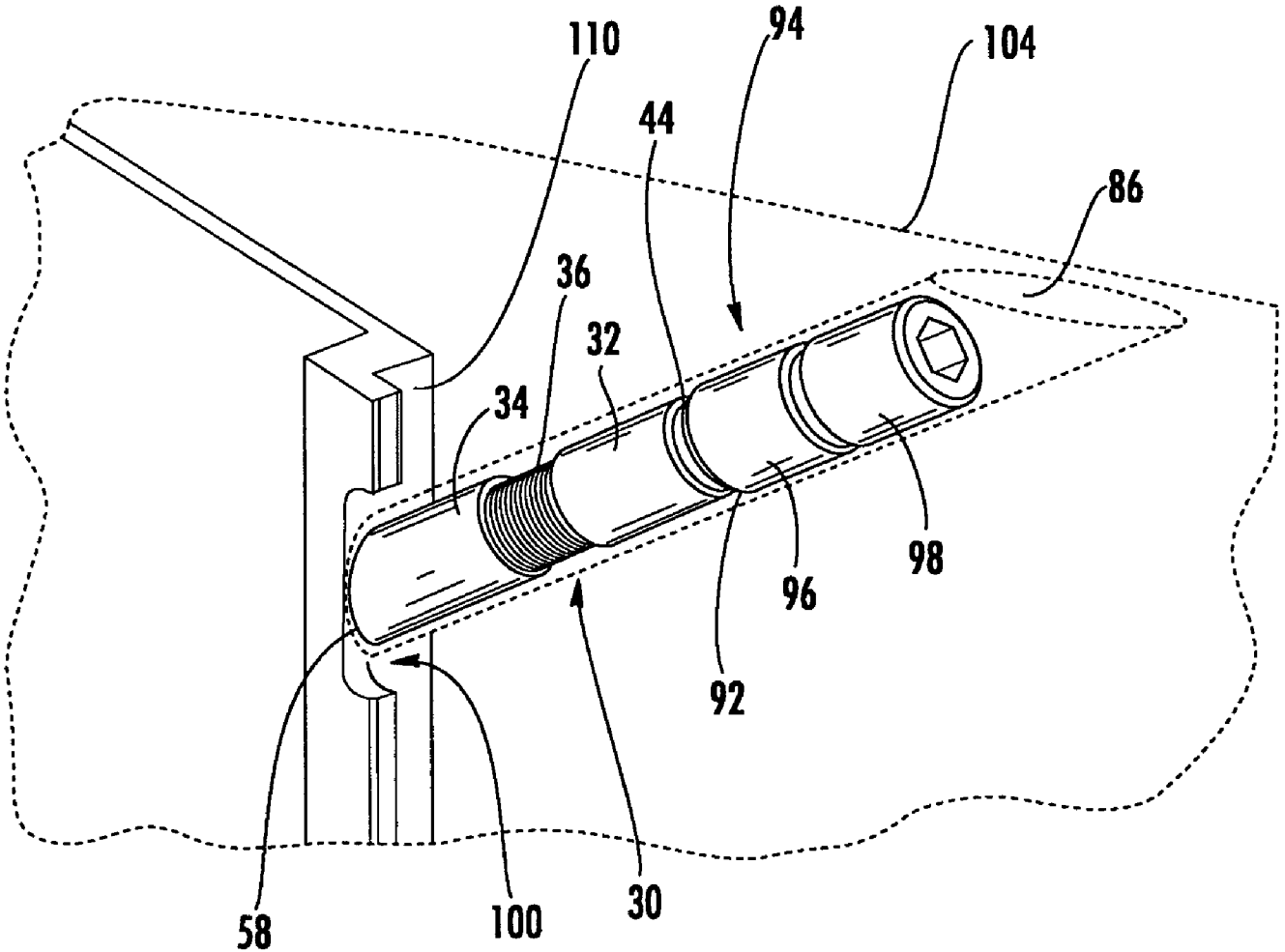
FIG. 11 is an isometric view of the load applying member of FIG. 6, showing the load applying member in its operational position in accordance with aspects of the invention.

Given the above context, the passage 86 will now be described. Again, the passage 86 receives at least a portion of the load applying member 30. The passage 86 can be provided in a region substantially proximate one of the circumferential ends 87 of the compressor shell segment 104*a*, such as shown in FIGS. 11 and 12. This region can include the circumferential end 87 itself. It should be noted that the positioning of the load applying member 30 in a region at or near the circumferential end 87 and/or the joint 106 is preferred for several reasons. First, the circumferential end 87 and/or the joint 106 is the area in which the outer shroud 110 typically undergoes the greatest range of motion. Second, experience has shown that the circumferential end 87 and/or the joint 106 is a frequent failure area. Third, the circumferential end 87 and/or the joint 106 provides a relatively easily accessible location for installation and other purposes.

Figure 14:
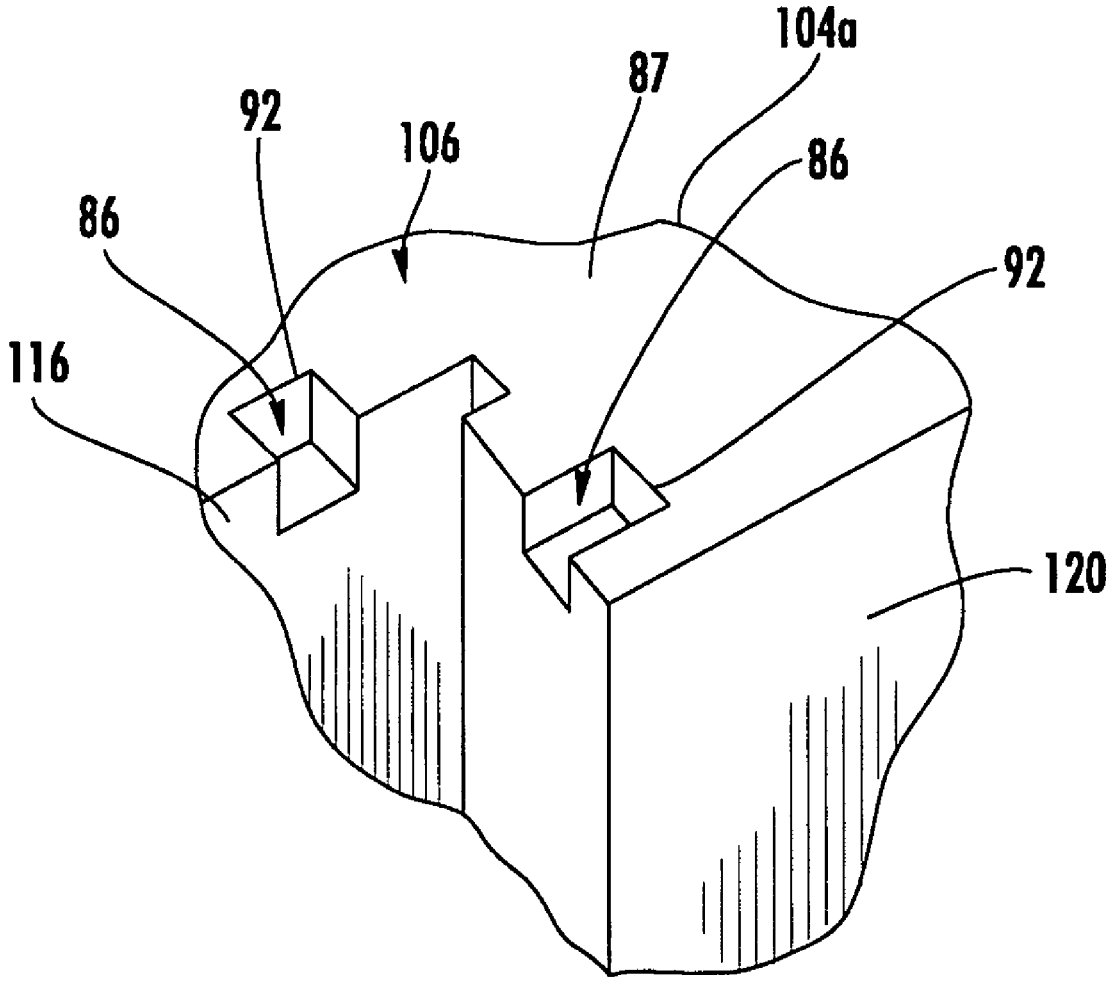
FIG. 14 is an isometric view of a compressor shell segment, taken at view FIG. 14 in FIG. 13, showing a first passage for receiving an axial load applying member and a second passage for receiving a radial load applying member according to aspects of the invention.
Figure 15:
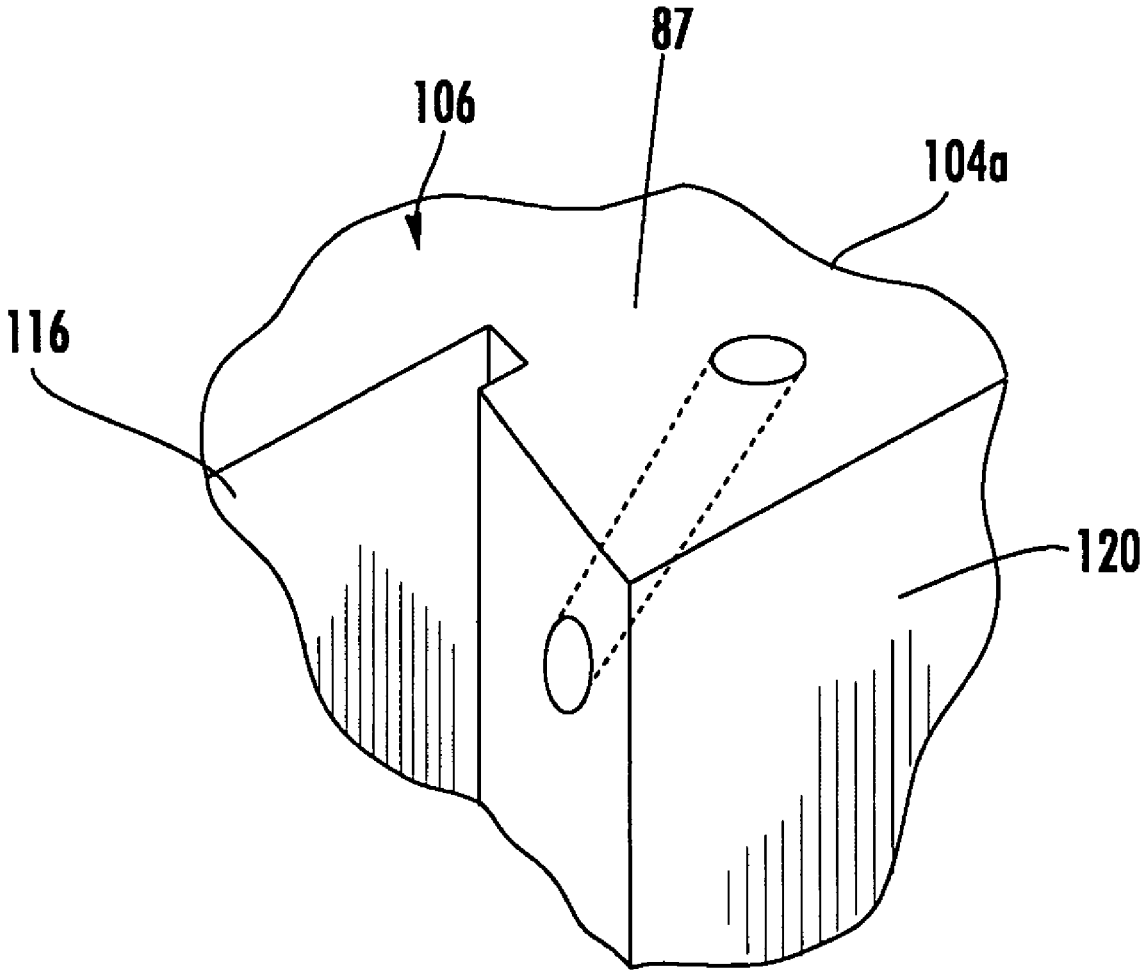
FIG. 15 is an isometric view of a compressor shell segment, taken at view FIG. 15 in FIG. 13, showing an alternative passage for receiving an axial load applying member according to aspects of the invention.

The passage 86 itself can have any of a number of configurations. It can be sized and shaped to accommodate the load applying member 30. The passage 86 can extend entirely through the compressor shell 104, as is shown in FIG. 15. In one embodiment, the passage 86 can have a back wall 92, as is shown in FIG. 14. In such case, the passage 86 can be entirely defined by the compressor shell 104. Alternatively, at least a portion of the passage 86 can be defined by other structure. For example, at least a portion of the passage 86 can be formed by a fastener 94 operatively positioned in the passage 86 so as to close the passage 86. In one embodiment, as shown in FIG. 11, the back wall 92 of the passage 86 can be formed by a set screw 96, which can threadably engages the passage 86 so as to close the passage 86. For greater safety, additional fasteners 94 can be used to prevent the set screw 96 from backing out during engine operation. To that end, a second set screw 98 can be used, as shown in FIG. 11. The second set screw 98 can be substantially adjacent to the first set screw 96.

The load applying member 30 can be assembled and inserted into the passage 86. When installed, the biasing member 36 can be under compression. Thus, the biasing member 36 can force the first and second portions 32, 34 apart and into engagement with the back wall 92 of the passage 86 and the outer shroud 110. It should be noted that the load applying member 30 can be oriented in various ways. In one embodiment, the first contact surface 44 can engage the back wall 92 of the passage 86, and the second contact surface 58 can engage the outer shroud 110. An example of such an arrangement is shown in FIG. 11. Alternatively, the first contact surface 44 can engage the outer shroud 110, and the second contact surface 58 can engage the back wall 92 of the passage 86. An example of this arrangement is shown in FIG. 12.

The load applying member 30 can be sized and shaped to substantially matingly engage the passage 86 in the compressor shell 104. It will be appreciated that, once assembled, the load applying member 30 can exert a substantially constant force on the diaphragm 108. The biasing member 36 can be designed to exert a predetermined preload on the outer shroud 110. In some instances, it may be necessary to make local alterations to the outer shroud 110 to facilitate engagement with the load applying member 30. For example, FIG. 11 shows a cutout 100 made in a portion of the outer shroud 110 to provide a suitable contact surface on the outer shroud 110.

It should be noted that the passage 86 can be oriented as needed so that the member 30 applies a preload on the compressor diaphragm 108 in the desired direction. For example, the passage 86 can open into the slot 116 in the direction of one of the axial ends 88, 90 of the shell 104. In one embodiment, the passage 86 can open into the slot 116 toward the upstream end 88 of the shell 104, as shown in FIGS. 13-15. As a result, the load applying member 30 can exert an axial force on an aft face 114 of the outer shroud 110 in the axial upstream direction, as shown in FIG. 5.

In another embodiment, the passage 86 can open into the slot 116 toward the downstream end 90 of the shell 104 such that the load applying member 30 can exert an axial force on a forward face 112 of the outer shroud 110 in the axial downstream direction 90. Alternatively or in addition to the above, the passage 86 can open into the slot 116 in a radial inward direction toward the compressor axis 102, as shown in FIGS. 13-14. In such case, the load applying member 30 can exert a force on the outer should 110 in the radial inward direction, as shown in FIG. 5.

Any number of load applying members 30 can be associated with each row of vanes. Of course, for a given row, the number of passages 86 needed depends on the number of load applying members employed. For each compressor shell segment 104*a*, the load applying members 30 can be provided in pairs at or near the joint 106, one at each of the circumferential ends 87. Thus, in one embodiment, there can be two axial load applying members 30. Each load applying member 30 can be positioned in a passage 86 formed in the compressor shell 104 at each circumferential end 87. In another embodiment, there can be a total of four load applying members 30 associated with each diaphragm 108: two load applying members 30 and associated passage 86 for each half of the compressor shell 104. In yet another embodiment, eight passages 86 can be provided, giving the option to choose which axial direction the load applying members 30 exert their force. Of course, there can be one or more load applying members 30 (and, if necessary, the associated passage 86) to exert a radial force on each diaphragm 108. In some instances, the physical geometry of the slot 116 and/or the outer shroud 110 of the diaphragm 108 may dictate the position and orientation of the passage 86 because of a lack of room to provide a passage 86.

In a preferred embodiment, the load applying member 30 can exert a force on the aft face 114 of the outer shroud 110 in the axially upstream direction 72. Providing an axial preload in this direction takes advantage of the gas load in the compressor because the gas load is opposite to the direction of the gas flow. That is, a gas flowing through the compressor is compressed, thereby increasing the pressure of the gas at each successive stage. As a result, the gas naturally seeks an area of lower pressure, which, in a compressor, will be axially upstream of a given point. Accordingly, the load applying member 30 can cooperate with the gas load to apply an axial preload to the outer shroud 110.

If an axial preload is to be applied to the outer shroud 110 of a particular diaphragm 108, then it is preferred if each of the load applying members 30 associated with that diaphragm 108 exert forces in the same axial direction. That is, the forces can either directed axially downstream or axially upstream, but not both. However, aspects of the invention include embodiments in which load applying members 30 exert opposite axial forces on the same diaphragm 108.

Further, the direction and/or magnitude of the forces exerted by one or more load applying members 30 in one row may or may not be the same in other rows. For example, one or more load applying members 30 can urge a first row diaphragm in an axially upstream direction, whereas one or more load applying members 30 can urge a second row diaphragm in a radially inward direction. Alternatively or in addition, the amount of force exerted by the load applying members 30 on the first row diaphragm can be greater than or less than the amount of force exerted by the load applying members 30 on the second row diaphragm. In addition, the quantity and specific type of load applying members can vary from row to row in the same compressor. Further, the geometry and type of load applying members need not be identical in the same row.

Based on the above, the advantages of a system according to aspects of the invention will be readily appreciated. Because the one or more load applying member exert a force on the outer shroud, relative movement between the compressor shell and outer shroud can be reduced, which, in turn, can minimize wear and prolong the life of these components. Further, it will be appreciated that the individual components of a load applying member in accordance with aspects of the invention have a relatively simple geometry. Thus, the components can be made at relatively low cost. In addition, the biasing member 36 can be configured as needed so that load applying member 30 exerts a predetermined load on the diaphragm 108.

Significantly, the load applying member 30 according to aspects of the invention still exerts a load on the outer shroud even after a certain amount of wear has occurred. When assembled, the load applying member 30 can exert a predetermined load on the diaphragm 108. Over time, wear will inevitably occur, though at an impeded rate because of the system according to aspects of the invention. Such wear can increase the clearances between the outer shroud and the compressor shell 104. Consequently, the amount of compression on the biasing members 36 decreases, which, in turn, reduces the amount of load that the member 30 applies to the diaphragm. Nonetheless, a load is maintained. Therefore, the system according to aspects of the invention does not lose its functionality at least over a certain range of wear. In contrast, wedge-based preload systems can lose their ability to exert a load on the diaphragm shortly after the onset of wear because the increased clearances release the wedge forces.

The foregoing description is provided in the context of one compressor system according to aspects of the invention. Of course, aspects of the invention can be employed with respect to myriad compressor designs, including all of those described above. Embodiments of the invention may have application to the turbine section of the engine in some instances. Thus, it will of course be understood that the invention is not limited to the specific details described herein, which are given by way of example only, and that various modifications and alterations are possible within the scope of the invention as defined in the following claims.

What is claimed is:

1. A system for reducing wear on a compressor diaphragm comprising:

a generally semi-cylindrical compressor shell segment having an inner peripheral surface, two circumferential ends, an axial upstream end and an axial downstream end, wherein the shell segment includes a slot extending along the inner peripheral surface from one circumferential end to the other circumferential end;

a diaphragm including an outer shroud with a plurality of airfoils extending radially inward therefrom, wherein the outer shroud is received within the slot in the compressor shell segment, whereby the diaphragm is mounted to the compressor shell segment; and a load applying member having a first portion and a second portion, the first and second portions being biased away from each other by a plurality of springs operatively positioned therebetween, wherein the load applying member is operatively positioned between the compressor shell segment and the diaphragm such that the load applying member exerts a force on the outer shroud, wherein one of the first portion and the second portion contacts the outer shroud, whereby relative movement between the outer shroud and the compressor shell segment is minimized.

2. The system of claim 1 wherein the springs are spring washers.

3. The system of claim 2 wherein a first spring washer of the plurality of spring washers is arranged in a first direction and a second spring washer of the plurality of spring washers is arranged in a second direction, wherein the second direction is opposite the first direction.

4. The system of claim 1 wherein the load applying member is positioned to exert a radially inward force on the outer shroud.

5. The system of claim 1 wherein the load applying member is positioned to exert an axial downstream force on the outer shroud.

6. The system of claim 1 wherein the load applying member is positioned to exert an axial upstream force on the outer shroud.

7. A system for reducing wear on a compressor diaphragm comprising:

a generally semi-cylindrical compressor shell segment having an inner peripheral surface, two circumferential ends, an axial upstream end and an axial downstream end, wherein the shell segment includes a slot extending along the inner peripheral surface from one circumferential end to the other circumferential end, wherein the shell segment further includes a passage therein, the passage having a back wall and opening into the slot in a region substantially proximate one of the circumferential ends;

a diaphragm including an outer shroud with a plurality of airfoils extending radially inward therefrom, wherein the outer shroud is received within the slot in the compressor shell segment, whereby the diaphragm is mounted to the compressor shell segment; and a load applying member having a first contact surface at one end and a second contact surface at an opposite end, the load applying member including a first portion and a second portion, wherein the first portion defines the first contact surface and the second portion defines the second contact surface, the second portion having a base and a protrusion extending therefrom, the first portion having a passage therein, wherein at least a portion of the protrusion is received in the passage in the first portion, the loading applying member further including a plurality of springs operatively positioned between the first and second portions such that the first and second portions are biased away from each other, wherein the load applying member is at least partially received in the passage in the compressor shell segment such that the load applying member exerts a force on the outer shroud, wherein one of the first portion and the second portion contacts the outer shroud, wherein one of the first contact surface and the second contact surface engages the back wall of the passage and the other of the first contact surface and the second contact surface engages the outer shroud, whereby relative movement between the outer shroud and the compressor shell is minimized.

8. The system of claim 7 wherein the springs are spring washers.

9. The system of claim 8 wherein a first one of the spring washers is arranged in a first direction and a second one of the spring washers is arranged in a second direction, wherein the second direction is opposite the first direction.

10. The system of claim 8 wherein the plurality of spring washers includes a first group of spring washers and a second group of spring washers, wherein the quantity of spring washers in the first group is not equal to the quantity of spring washers in the second group.

11. The system of claim 7 wherein the passage extends substantially radially in the compressor shell segment, wherein the load applying member exerts a radially inward force on the outer shroud.

12. The system of claim 7 wherein the outer shroud has a forward face and an aft face, wherein the passage opens into the slot toward the axial upstream end of the shell segment, whereby the load applying member exerts an axial force on the aft face of the outer shroud in the axial upstream direction.

13. The system of claim 7 wherein the outer shroud has a forward face and an aft face, wherein the passage opens into the slot toward the axial downstream end of the shell segment, wherein the load applying member exerts a force on the forward face of the outer shroud in the axial downstream direction.

14. The system of claim 7 wherein the protrusion of the second portion has an associated axis, wherein the second contact surface is angled from about 30 degrees to about 60 degrees relative to the axis.

15. The system of claim 7 wherein the load applying member exerts a substantially uniform load on the outer shroud.

16. The system of claim 7 wherein the back wall of the passage in the compressor shell segment is formed by the compressor shell segment.

17. The system of claim 7 wherein the back wall of the passage in the compressor shell segment is formed by a first fastener operatively positioned in the passage in the compressor shell segment.

18. The system of claim 17 further including a second fastener operatively positioned in the passage in the compressor shell segment, whereby the second fastener prevents the first fastener from backing out in the passage in the compressor shell segment.

19. The system of claim 7 wherein the first and second portions are connected by a retaining member.

20. The system of claim 7 wherein at least one of the first and second contact surfaces of the load applying member are coated with a wear resistant material.

* * * * *